United States Patent [19]

Berger et al.

[11] Patent Number: 4,761,864

[45] Date of Patent: Aug. 9, 1988

[54] PARALLEL THREAD SUPPLY SYSTEM

[75] Inventors: Johann Berger, Alfdorf; Josef Berger, Schwäbisch Gmund-Grossdeinbach, both of Fed. Rep. of Germany

[73] Assignee: Elastic-Berger OHG, Alfdorf, Fed. Rep. of Germany

[21] Appl. No.: 562,032

[22] Filed: Dec. 15, 1983

Related U.S. Application Data

[63] Continuation of Ser. No. 242,526, Mar. 11, 1981, abandoned.

[30] Foreign Application Priority Data

Mar. 13, 1980 [DE] Fed. Rep. of Germany ..... 3009610

[51] Int. Cl.[4] ..... D02G 1/00; D04B 19/00

[52] U.S. Cl. ..... 28/218

[58] Field of Search ..... 28/171, 218, 166, 194; 139/432

[56] References Cited

U.S. PATENT DOCUMENTS

| | | | |
|---|---|---|---|
| 2,596,246 | 5/1952 | Johnson et al. | 28/166 X |
| 2,857,651 | 10/1958 | Keen | 28/218 X |
| 3,064,689 | 11/1962 | Piazzolla et al. | 139/432 |
| 3,466,718 | 9/1969 | Adamson | 28/218 X |
| 3,605,225 | 9/1971 | Gibson et al. . | |
| 3,842,576 | 10/1974 | Rosenstein | 28/218 X |
| 3,930,357 | 1/1976 | Gibson | 28/171 X |
| 4,091,512 | 5/1978 | Chambley et al. | 28/218 X |
| 4,118,842 | 10/1978 | Norris et al. | 28/218 |
| 4,173,990 | 11/1979 | Langlois et al. . | |

FOREIGN PATENT DOCUMENTS

| | | | |
|---|---|---|---|
| 2726181 | 12/1977 | Fed. Rep. of Germany . | |
| 2825537 | 12/1979 | Fed. Rep. of Germany . | |
| 17296 | of 1892 | United Kingdom | 28/194 |
| 1163732 | 9/1969 | United Kingdom | 28/171 |

*Primary Examiner*—Robert R. Mackey

*Attorney, Agent, or Firm*—Cushman, Darby & Cushman

[57] ABSTRACT

A textile material for supplying parallel threads to a machine for manufacturing two-dimensional textile fabrics. The material is loosely woven and has a low number of withdrawable weft loops 3 per unit length. Immediately prior to entering an end-product machine weft thread 2 is withdrawn to the side, so that the remaining group 1 of threads enters the machine. The material passes over braked rollers 31,32 and a bar 35. Retainer stitches 7 are unravelled and the weft thread 2 is passed through a guide 55 onto a transport device 57.

4 Claims, 5 Drawing Sheets

PARALLEL THREAD SUPPLY SYSTEM

This is a continuation of application Ser. No. 242,526, filed Mar. 11, 1981, now abandoned.

DESCRIPTION

The invention relates to the supply of parallel threads to machines for manufacturing two-dimensional textile fabrics.

Such machines will be called "end-product machines", and can be looms or warp knitting machines, crocheting machines or generally any machine which processes a group of parallel threads. Such "threads" include monofilaments, yarns, twines, and ribbons, any of which may be elastic. "Two-dimensional textile fabrics" include woven and knitted fabrics, nets, and hose material.

It is known to supply the end-product machines with parallel threads using a warper's beam. The use of beams entails disadvantages. As soon as the beam has run out, it must be replaced by another. The threads of the empty beam and those of the new one must be knotted together, and during this time the end-product machine must be at a standstill. The knotting of the threads together takes a lot of time and reduces the availability of end-product machines. As the threads are wound off the beam, they make the roll smaller, and so change the angle at which the threads to the subsequent guide element, the back rail. Thus, as the beam size decreases, the tension of the thread changes. Alternatively, in order to compensate for changes in tension, mechanical and/or electronic devices may be employed at considerable cost. Warper's beams entail storage space and transport costs.

It is also known to supply end-product machines with parallel threads direct from a warping creel, that is a frame carrying a number of yarn packages. Warping creels require a large amount of space and considerable investment. Each bobbin requires a mounting position and a brake. Each of the threads leaving the packages require various guides.

The invention provides a textile material for supplying parallel threads to a machine for manufacturing two-dimensional textile fabric comprising loosely woven material containing withdrawable weft loops.

The number of weft loops per unit length depends on the nature of the end product. If, in an extreme case, the end product is to have 200 weft loops per cm, the loosely woven material might have 20 weft loops per cm. In most cases, however, the loosely woven material has much fewer weft loops per unit length. The weft loops should preferably be woven in such a way that they can be withdrawn as a continuous thread at a later stage, the withdrawal being carried out efficiently, and the weft thread can be re-used. Weft threads may be inserted from opposite sides of the material. After the weft has been withdrawn, a group of parallel threads remains which can be supplied directly to one or several work positions of the end-product machines. The weft threads withdrawn from the loosely woven material may be re-used in the manufacture of the end product.

The loosely woven material may be stored in stores or constainers in an orderly fashion or at random. A store might hold several tons of loosely woven material instead of several warper's beams. The loosely woven material can be transported at low cost. No bobbins or similar elements are necessary, but collapsible containers, cardboard boxes, or open-work boxes can be used which take up little space during return transport.

In a factory manufacturing end products, the supply of this material can be positioned away from the end-product machines and/or the machine manufacturing the loosely woven material, for example, in a separate storage room. The loosely woven material can be transported over large distances by means of guide mechanisms into the storage area and/or to end-product machines. The loosely woven material does not have to be produced in a factory producing end products, but it can be supplied to such a factory. For most applications, loosely woven materials can be employed containing less than one weft loop per cm length, often less than one weft loop per 10 cm length.

The loosely woven material can be produced using a single weft thread, but two or more weft loops may be inserted from either side. For this purpose, a corresponding number of insertion instruments can insert weft loops into one and the same shed. This is recommended particularly for wide loosely woven material. The closed ends of the weft loops may protrude from the sides of the loosely woven material. The use of rough threads ensures that they have sufficient hold. If a group of smooth threads is to be woven and/or if a particularly loose fabric is required, the closed ends of the weft loops may be secured along at least one edge by a row of stitches which can be undone. During processing of the loosely woven material, the row of stitches opens as the weft loops are withdrawn. The same applies when there is a row of stitches along each edge. The row of stitches may be formed involving the weft loops themselves, i.e. using only the weft threads or alternatively by using an additional auxiliary thread. In The last case, it is necessary to withdraw not only the weft loop but also the associated auxiliary thread during processing.

The invention includes a process for supplying an end-product machine with parallel threads in which a textile material according to the invention is fed to the machine and has the weft loops withdrawn before the textile material reaches the work position of the machine. The loosely woven material is initially supplied to a braking device so that the threads are held under tension. The threads are preferably withdrawn from the side(s) of the tensioned material and wound on a bobbin. Subsequently, the threads may be supplied as a whole to a work position of an end-product machine. Alternatively. The threads may be divided and supplied to several work positions. Conversely, at least two textile materials may be supplied to a single work position, particularly if the end product is wide, e.g. requires 4000 warp threads, while the loosely woven textile material contains only 500 warp threads. End products can be produced from threads with different characteristics by using loosely woven material with threads of different characteristics, for example, as to the dye, shrinkage, or texturing. Attention must be paid to the direction in which the textile material is supplied for the stitches to be unravelled as the rows of stitches can be unravelled only in the direction contrary to that in which they are introduced. Some characteristics can be given to the textile material by subjection to a finishing process before feeding to an endproduct machine which enables the end-product manufacturer to carry out finishing processes on smaller quantities of threads. This includes, for example dyeing or shrinking and thermal fixing. Sections of the textile material may be dyed in different colours in the longitudinal direction, so that it is possible to manufacture a cross-striped end product.

The ends of the threads of one piece of textile material may be knotted to the beginnings of the threads of another piece of textile material while the end-product machine is working. Knotting can therefore be carried out without having to stop the machine. When the material housed in one store has been used up, material housed in the next store and connected to the preceding one can be pulled out and supplied to the machine without interruption.

The invention includes a device for supplying an end-product machine with parallel threads which comprises means for feeding a textile material according to the invention, a braking device for the material, and means for withdrawing the weft loops before the textile material reaches the work position of the machine. The expression "braking device" includes driving devices which will not accelerate as a result of the pull exercised by the end-product machine. The braking device may include at least one roller. A winding device for the withdrawn thread may include at least one roller. A winding device for the withdrawn thread(s) may also be provided.

The invention includes a device for the manufacture of a textile material according to the invention comprising a loom having at least one weft loop insertion instrument and a weft loop retainer which retains the closed end of an inserted weft loop and releases it after changeover of the weaving shed. A weft-loop retainer may be associated with each weft loop inserter, and be arranged at the exit of the weft needle after passing through the weaving shed. If the material to be produced has to be very loose, it is convenient to retain the closed end of the weft loop at least temporarily outside the fabric edge. In its simplest form, the weft loop retainer may be a mandrel which reciprocates transversely to the plane of the weft loop, or a knitting needle to produce a row of stitches. The device may include a deflection bar transverse to the fabric path between the fabric path and the knitting needle path. This may be immediately behind the beat up position of a reed of the loom in the pull-off direction.

The lower the number of weft loops per unit fabric length, the cheaper it is to produce the textile material with one or two rows of stitches. For very low weft loop densitites per unit length, the distance which the finished article travels per double weft as it is pulled off is markedly longer than the distance which the knotting needle travels back and forth per double weft. The deflection bar and a weft retainer ensure satisfactory operation of the loom even if the weft loop density is very low. The device may include a weft thread retainer which moves up and down on the side of the fabric opposite to the weft loop retainer and retains a loop as the weft is inserted. Thus the loop is formed by the weft thread coming out of the fabric and newly inserted weft thread, and the loop is released during the return of the weft insertion instrument.

The textile material according to the invention can be produced from threads wound on a number of individual bobbins, and the bobbins may be mounted on a creel, or from threads coming directly from a thread producing or thread processing machine (e.g. a twisting machine, thread stretching machine or thread finishing machine). If such a machine supplies only a fraction of the required threads, several machines may be used simultaneously, and they are preferably synchronously driven. Thus, a manufacturer or finisher of threads may supply textile material instead of bobbins. The material may alternatively be manfuactured in a factory which also produces the end-product. Instead, it may be woven from threads leaving a thread producing machine or a thread processing machine or a rubber-thread covering machine, if elastic threads are required. If material is required which has more warp threads than one of the these machines can supply, several such machines may be driven synchronously to produce a common supply of the required warp threads.

The material produced can be stored, in particular in containers, in an orderly fashion or at random.

The containers may be supplied from a factory producing material for an end-product manufacturer. Alternatively, at least one loom for producing the material may be arranged in a factory which produces the end-product. Such a machine produces textile material from bobbins and supplies it to larger stores arranged permanently in the end-product factory. The stores may be arranged at a considerable distance from the machine producing the material and also from the end-product machines. The material can be supplied via guides to the stores, and from these to the end-product machines. If several containers are filled one after the other, there is no need to interrupt the flow of material. If the beginning of the container filled last is supplied to an end-product machine, this can process the material in a succession from all the containers without interruption and without further knotting.

DRAWINGS

Figure 12:
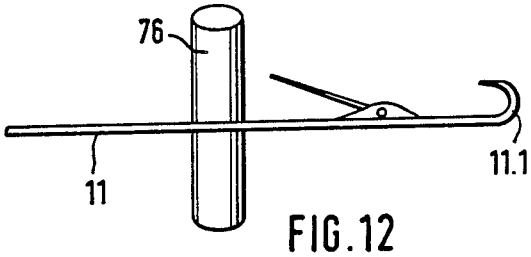
Figure 13:
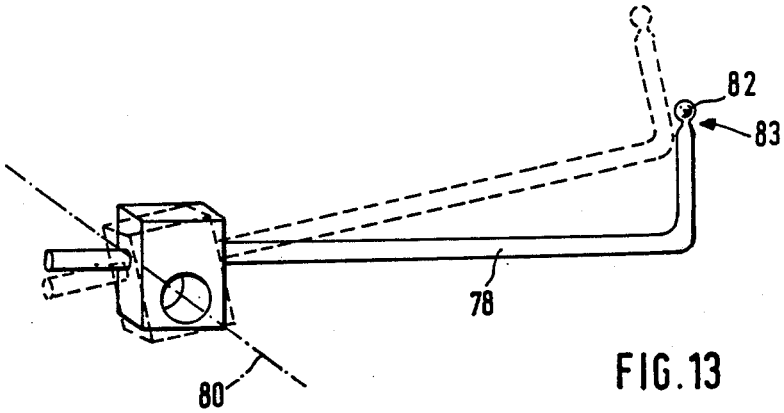
Figure 10:
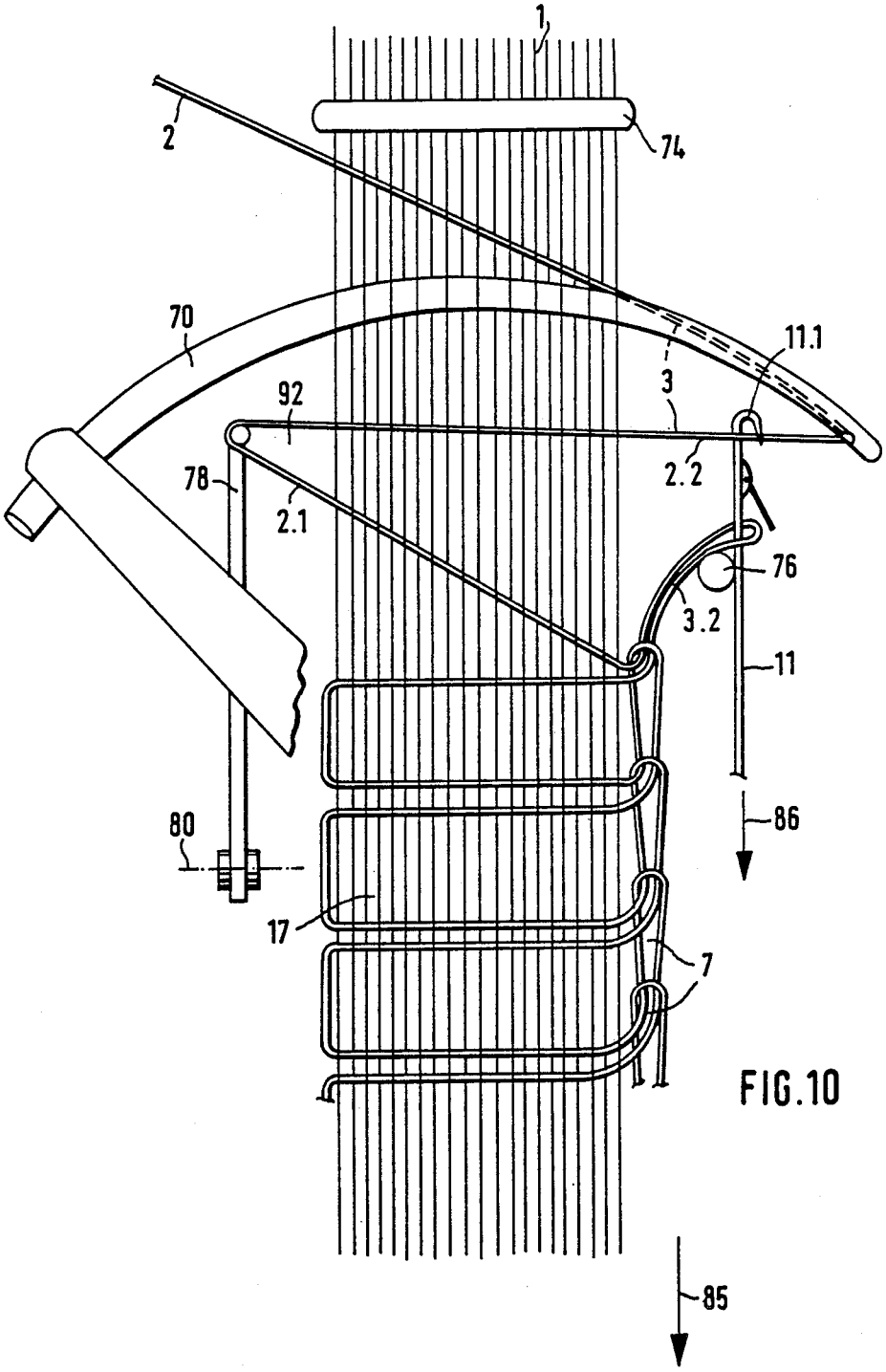
Figure 11:
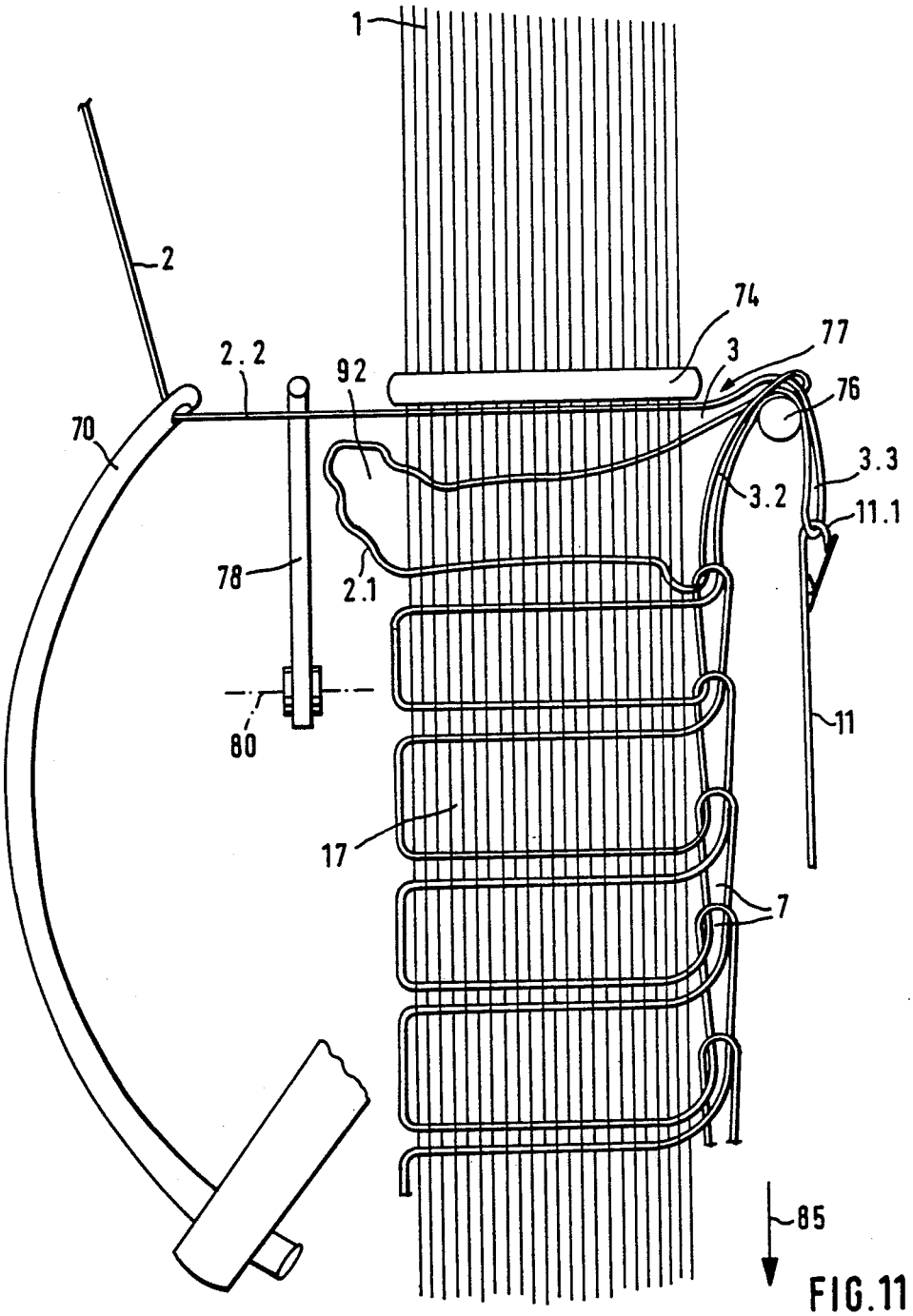

FIGS. 10 and 11 show devices for the manufacture of material according to the invention; and FIGS. 12 and 13 show individual parts of the devices of FIGS. 10 and 11.

Figure 1:
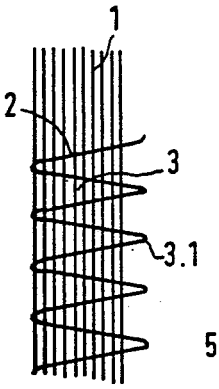
FIGS. 1 to 4 shows schematically weaving and knitting techniques for the manufacture of textile material according to the invention.
Figure 2:
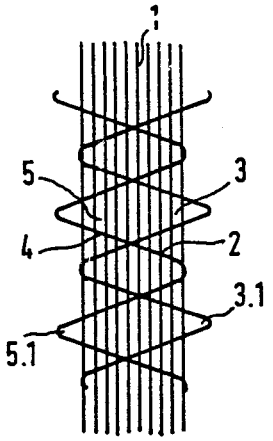

In FIG. 1, weft loops 3 formed from a weft thread 2 are inserted from the left into a group 1 of warp threads, in such a way that closed ends 3.1 of the weft loops protrude on the right side by 1 to 2 cm. If rough threads are used, the loosely woven material is thus sufficiently secured against unintentional unravelling. This method is suitable for materials having at least 1 weft loop per 1 cm material length. In FIG. 2, weft loops 3 are inserted form the left, while at the same time weft loops 5 of another weft thread 4 are inserted from the right at opposite points. Both weft loops are inserted by an inserter each into the same shed. On the right and on the left, closed ends 3.1 and 5.1 protrude from the weave. This method is suitable for material with a lower number of loops per unit fabric length than FIG. 1.

Figure 3:
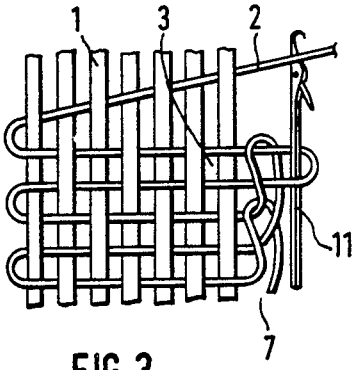
Figure 4:
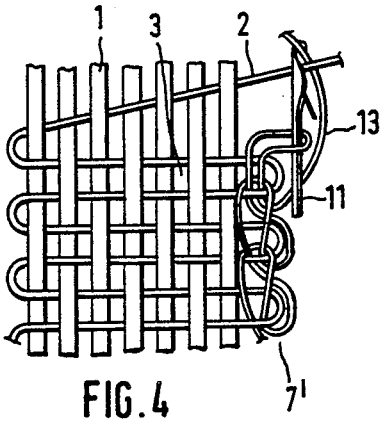

For loop numbers as low as 1 per 10 cm fabric length and even lower, FIGS. 3 and 4 are suitable. In FIG. 3, the material is provided with a row of stitches 7 which is formed by the weft thread 2 using a knitting needle 11. If very low loop numbers per cm are to be produced, this method can be employed on both sides. That is to say weft loops inserted from the right to the left may be secured by a second row of stitches on the left side. The row of stitches can be undone together with the weft loops 3. If the knitting needle 11 in FIG. 3 is removed, the uppermost weft loop 3 can be undone pulling to the left. Then follows the next one underneath it, and the associated stitch is undone at the same time. This process of undoing, therefore, must be started at the end woven last.

FIG. 4 shows the manufacture using an auxiliary thread 13. Here a row of stitches 7' is formed by the weft loops 3 and the auxiliary thread. To undo it, the auxiliary thread 13 on the one hand, and the weft thread 2 on the other hand, must be withdrawn. Using two weft threads, weft loops may be inserted from the right and from the left, and both can be secured by an auxiliary thread forming a row of stitches on either side.

Figure 5:
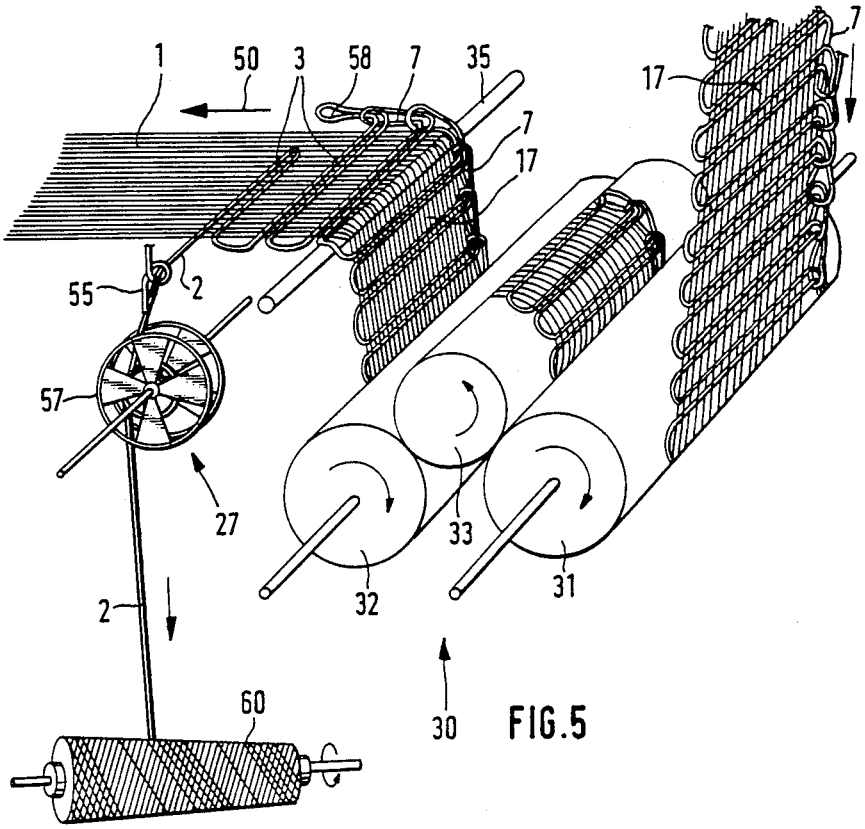
FIG. 5 shows a device for supplying a textile material according to the invention from a store to a work position of an end-product machine.

FIG. 5 shows a device which is arranged between a container for the loosely woven material and a work position of an end-product machine. This serves, on the one hand, to tension the supplied group 1 of warp threads, and on the other hand, to withdraw the weft thread 2. This has been illustrated using the example of FIG. 3 where a row of stitches 7 is woven using the weft thread 2. The material 17 is initially supplied to a braking device 30 which has brakable rollers 31 and 32, also an auxiliary roller 33 for pressing the material against the two other rollers. The warp threads are pulled from the work position of the end-product machine in the direction of an arrow 50, so that the warp threads are held tensioned between the work position and the braking device. Once past the braking device, the material is guided around a stationary round bar 35. Shortly afterwards, the weft thread 2 is withdrawn in a forward direction, and the row of stitches 7 is undone. The weft thread 2 is guided through a thread guide 55 to a thread transport device 57. The latter ensures that the weft thread is pulled out at a certain speed. The pulling speed is chosen to match the length of the weft loops 3 to be withdrawn, the stitches 58 formed by them, and the rotational speed of the rollers 31,32. The withdrawn weft thread 2 is wound on a bobbin 60 and may be used again, thus not increasing the material cost.

Figure 6:
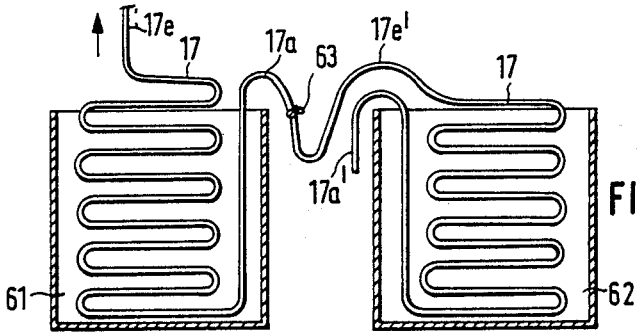
FIG. 6 shows how the ends of the material in the stores are knotted together.

Loosely woven material stored in containers 61,62 (FIG. 6) is knotted together warp thread to warp thread. This can be done while the material is supplied from a store to an end-product machine. If the material has one or two rows of stitches, the procedure is as follows: The loosely woven materails are stored in such a way that not only the ends 17*e*, 17*e*' produced last, but also the ends 17*a*, 17*a*' produced first, remain accessible from the outside. The end 17*e* of the loosely woven material produced last and stored in store 61 is supplied to a braking device 30 as in FIG. 5. The end 17*a* of this loosely woven material produced first, and the end 17*e*' of the loosely woven material in store 62 produced last, are knotted together, i.e. warp thread with warp thread and weft thread with weft thread, and possibly auxiliary thread with auxiliary thread. When store 61 is empty, the end 17*e*' will follow the end 17*a* and then the store 62 will be emptied. The knotted ends 63 of the warp threads of this material pass through the end product machine. If necessary the piece of end product containing the knotted ends may be cut out at a later stage. Empty stores are either replaced by full ones or are left where they are and re-filled from a machine producing the material.

Figure 7:
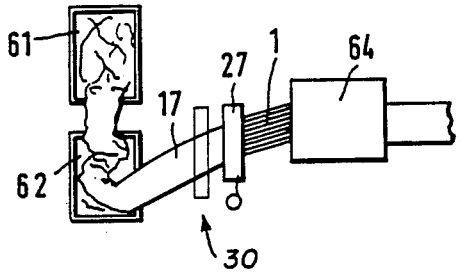
FIGS. 7 to 9 show various methods of supplying the material to the work positions of end-product machines.
Figure 8:
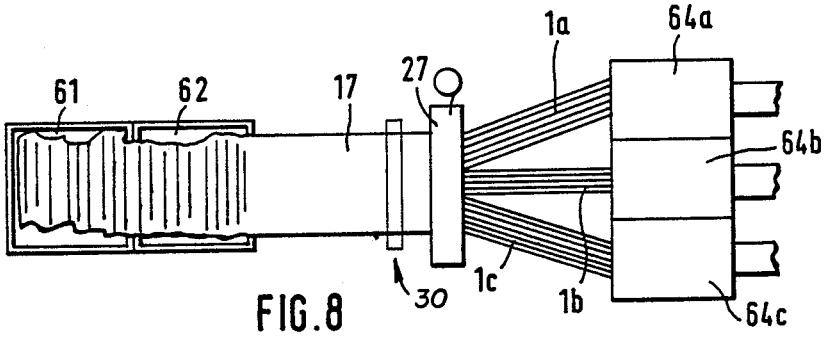

In FIG. 7, textile material 17 is supplied alternately from stores 61, 62, or from more than two stores, via an unravelling device 27 to a work position 64. The braking device 30 preceding the unravelling device 27 is not shown in FIGS. 7 to 9. In FIG. 8, textile material 17 is again supplied from one of two stores 61,62 to an unravelling device 27. The group of threads leaving this device is divided into three groups 1*a*, 1*b* and 1*c*. Each of these partial groups of threads is supplied to a work position 64*a*, 64*b* and 64*c*.

Figure 9:
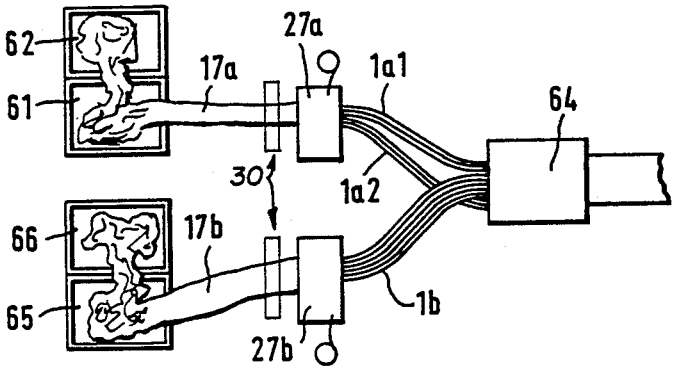

The material supplied according to FIG. 9 has various characteristics. Stores 61,62 contain loosely woven material 17*a* of a certain characteristic, while stores 65,66 contain loosely woven material 17*b* of another characteristic. The characteristics may be a different dye, different values of elongation at break or different shrinkages of the warp threads. The loosely woven material 17*a* enters an unravelling device 27*a*, the loosely woven material 17*b* an unravelling device 27*b*. The group of threads 1*b* leaving this device 27*b* is supplied across its whole width to a work position 64. The group of threads leaving the unravelling device 27*a* is divided into two groups of threads 1*a*1 and 1*a*2. The two partial groups form the warp threads for the selvage of the woven or knitted fabric manufactured at the work position 64. This arrangement is of importance for the manufacture of vehicle safety belts with tubular selvages where the selvage threads are shrunk more than the warp threads of the center part. Analogously, a work position 64 may be supplied with several adjacent groups of threads which come from various loosely woven materials, for instance a fabric can be manufactured which has stripes in various colours in longitudinal direction.

FIGS. 10 to 13 show the manufacture of narrow material on a needle loom. A group 1 of warp threads is supplied to the needle loom from a thread processing machine or from a bobbin creel. It comprises a weft thread insertion needle 70, a knitting needle 11 and a reed 74. The knitting needle is movable in a longitudinal direction of the fabric between its two end positions, which are illustrated in FIGS. 10 and 11. A deflection bar 76 in the form of a ceramic cylinder is arranged vertically close to the working path of the knitting needle, i.e. closely behind the beat-up position 77 of the reed 74 (FIG. 11). On the side of the fabric path which is opposite to the knitting needle, an angled weft thread retainer 78 (FIG. 13) is arranged pivotably about a horizontal axis 80. Such a thread retainer is also called "stitcher". FIG. 13 shows its two extreme positions. Below its ball-shaped end 82, it has a constriction 83 for guiding the weft thread 2.

Operation

In FIG. 10, the weft thread 2.1 coming from the fabric passes round the constriction of the weft thread retainer 78 which is in its upper position. The weft thread insertion needle 70 has inserted a loop 3 of the weft thread toward the right, and the head 11.1 of the knitting needle 11 has just gripped the piece 2.2 of the weft thread and starts to move in pull-off direction (arrows 85,86). The shaft of knitting needle 11 still holds a weft loop 3.2 from the previous stitch formation. While the material 17 is being pulled off, the knitting needle moves into its end position (FIG. 11) whereby a stitch is formed from the previously formed loop 3.2 and is knocked over. A new loop 3.3 is formed which is an elongation of the weft loop 3. The loop 3.3 is pulled by the head 11.1 of the knitting needle around the deflection bar 76 in pull-off direction (arrow 85). The weft thread retainer 78 has moved in a downward direction and released the weft thread 2.1, creating a temporary loose loop 92 in the fabric. Following the beat-up movement of the reed and the change-over of the shed, the cycle is repeated, whereby the loop 92 is pulled taught as a result of the force pulling the fabric. Material of greater width can also be produced by the insertion of weft loops, but the insertion needle 70 illustrated in FIGS. 10 and 11 is replaced by other instruments.

We claim:

1. A system for supplying at least one work position of at least one machine for producing a two-dimensional fabric with warp threads comprising means for holding a predetermined supply of a textile material comprised of said warp threads and loosely woven withdrawable weft loops, said withdrawable weft loops being held in place by having a portion of the end forming said weft loops being formed into stitches extending in a row along one side of the textile material, means for removing said textile material from said supply means and for separately removing said withdrawable weft loops so that only parallel warp threads remain, and means for feeding the parallel warp yarns in that condition directly to said at least one work position, said feeding means including control means adjacent the position where weft loops are withdrawn for controlling the feed rate of the textile material at that position.

2. A system according to claim 1 further including take up means for taking up the thread of the withdrawn weft loops.

3. A system according to claim 2 wherein the feed rate control means comprises a braking device.

4. A system as in claim 3, wherein said braking device comprises first and second brake rollers positioned adjacent one another and a third roller mounted so as to be pressable against, said first and second brake rollers so that said third roller can press material wrapped therearound against said first and second brake rollers to develop the desired warp thread tensioning.

* * * * *